US008113265B2

(12) United States Patent
Hardison, III et al.

(10) Patent No.: US 8,113,265 B2
(45) Date of Patent: Feb. 14, 2012

(54) WASHDOWN DOOR

(75) Inventors: Carl David Hardison, III, Preston, IA (US); James C. Boerger, Franksville, WI (US); Peter S. Schulte, East Dubuque, IL (US); Thomas Jansen, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 185 days.

(21) Appl. No.: 12/396,075

(22) Filed: Mar. 2, 2009

(65) Prior Publication Data

US 2010/0218431 A1 Sep. 2, 2010

(51) Int. Cl.
*A47G 5/02* (2006.01)

(52) U.S. Cl. ..... 160/273.1; 160/179; 160/44; 160/41

(58) Field of Classification Search ..... 160/273.1, 160/179, 44, 40, 41, 121.1, 133
See application file for complete search history.

(56) References Cited

U.S. PATENT DOCUMENTS

| | | | | |
|---|---|---|---|---|
| 1,915,704 | A | 6/1933 | Warren | |
| 2,134,397 | A | 10/1938 | Clark | |
| 3,146,824 | A | 9/1964 | Veilleux | |
| 3,724,526 | A | 4/1973 | Huprich | |
| 4,016,920 | A * | 4/1977 | Shepard | 160/133 |
| 4,100,931 | A | 7/1978 | Pantland et al. | |
| 4,186,790 | A | 2/1980 | Schenker et al. | |
| 4,250,941 | A | 2/1981 | McNally | |
| 4,344,473 | A | 8/1982 | Shore | |
| 4,357,978 | A | 11/1982 | Keller et al. | |
| 4,407,349 | A | 10/1983 | Ekstrom | |
| 4,502,522 | A | 3/1985 | Liljendahl | |
| 4,947,937 | A | 8/1990 | Searer et al. | |
| 5,107,917 | A * | 4/1992 | Larsson | 160/229.1 |
| 5,526,865 | A * | 6/1996 | Coenraets | 160/272 |
| 5,752,557 | A | 5/1998 | Crider et al. | |
| 6,119,758 | A * | 9/2000 | Coenraets | 160/273.1 |
| 6,247,517 | B1 | 6/2001 | Drifka et al. | |
| 6,250,321 | B1 * | 6/2001 | Ernst | 135/88.11 |

(Continued)

FOREIGN PATENT DOCUMENTS

DE 3115129 11/1982

(Continued)

OTHER PUBLICATIONS

International Searching Authority, "Partial Search Report," issued in connection with international application serial No. PCT/US2010/025784, mailed Jul. 12, 2010, 7 page.

(Continued)

*Primary Examiner* — Blair M. Johnson
(74) *Attorney, Agent, or Firm* — Hanley, Flight & Zimmerman, LLC

(57) ABSTRACT

An example of a door with a pliable curtain includes various washdown features that make the door particularly suitable for use in food and drug related environments that demand cleanliness. To prevent product contamination, such as bacteria and other microorganisms, some examples of the door include a curtain storage track with a spiral groove machined in a unitary block of plastic, a ventilated side frame with a removable curtain guide track and a removable seal, and various curtain seams that not only join multiple sheets of the curtain together but also promote and strategically direct liquid runoff to avoid creating water-holding surfaces and to prevent liquid from dripping on products passing through the doorway.

26 Claims, 14 Drawing Sheets

U.S. PATENT DOCUMENTS

| | | | | |
|---|---|---|---|---|
| 6,390,171 | B2 | 5/2002 | Drifka et al. | |
| 6,591,432 | B1 * | 7/2003 | Feinstein et al. | 4/558 |
| 6,659,158 | B2 | 12/2003 | Laugenbach | |
| 6,962,188 | B2 | 11/2005 | Coenraets | |
| 7,089,990 | B2 * | 8/2006 | Hormann et al. | 160/201 |
| 2002/0059985 | A1 | 5/2002 | Stoebich et al. | |
| 2003/0019539 | A1 | 1/2003 | Hornwood | |
| 2003/0019592 | A1 | 1/2003 | Rejc | |
| 2003/0213180 | A1 | 11/2003 | Ueda | |
| 2004/0040672 | A1 | 3/2004 | Nagar | |
| 2006/0137836 | A1 | 6/2006 | Harbison | |
| 2007/0277942 | A1 | 12/2007 | Dondlinger et al. | |
| 2008/0064087 | A1 | 3/2008 | O'Neill et al. | |

FOREIGN PATENT DOCUMENTS

| | | |
|---|---|---|
| DE | 10318146 | 10/2004 |
| EP | 0816624 | 1/1998 |
| EP | 1191176 | 3/2002 |
| EP | 1191184 | 3/2002 |
| EP | 1213433 | 6/2002 |
| EP | 1233140 | 8/2002 |
| EP | 1213432 | 4/2003 |
| FR | 1423730 | 1/1966 |
| GB | 2093895 | 9/1982 |
| WO | 8807122 | 9/1988 |
| WO | 9112404 | 8/1991 |
| WO | 0215755 | 2/2002 |
| WO | 02066776 | 8/2002 |
| WO | 03027424 | 4/2003 |
| WO | 2007142079 | 12/2007 |

OTHER PUBLICATIONS

International Searching Authority, "International Search Report," issued in connection with international application serial No. PCT/US2010/025784, mailed Nov. 29, 2010, 5 pages.

International Seacrhing Authority, "Written Opinion of the International Searching Authority," issued in connection with international application serial No. PCT/US2010/025784, mailed Nov. 29, 2010, 9 pages.

International Bureau, "International Preliminary Report on Patentability," issued in connection with international application serial No. PCT/US2010/025784, mailed Sep. 15, 2011, 10 pages.

* cited by examiner

WASHDOWN DOOR

FIELD OF THE DISCLOSURE

This patent generally pertains to doors and, more specifically, to doors that can be periodically washed down to kill bacteria and other microorganisms.

BACKGROUND

General-purpose, vertically operating doors often have a flexible curtain that opens by rising from a vertical set of tracks installed alongside a doorway. Upon rising, the curtain transfers from the vertical tracks over to an overhead storage system. The actual design of the storage system may vary depending on the available space above the doorway and other considerations. An overhead storage system, for example, can be in the form of a take-up roller that draws in the curtain to open the door, or the storage system can be a set of horizontal, vertical, inclined, or coiled tracks that lead to the set of vertical tracks alongside the doorway.

Some vertically operating doors also include some type of protective breakaway feature that allows the curtain to temporarily separate from its guide tracks in the event of a collision such as, for example, the door's curtain being accidentally struck by a forklift passing through the doorway while door is only partially open.

Due to a vertically operating door's numerous intricate parts such as the door's vertical tracks; seals; overhead storage system; breakaway feature; and even the curtain itself, which can be comprised of multiple interconnected sheets and perhaps a window, such doors can be difficult to keep clean in environments that demand cleanliness. Many doors in the food and drug industry, for instance, need to be periodically washed down and sanitized in order to prevent product contamination.

DETAILED DESCRIPTION

Figure 1:
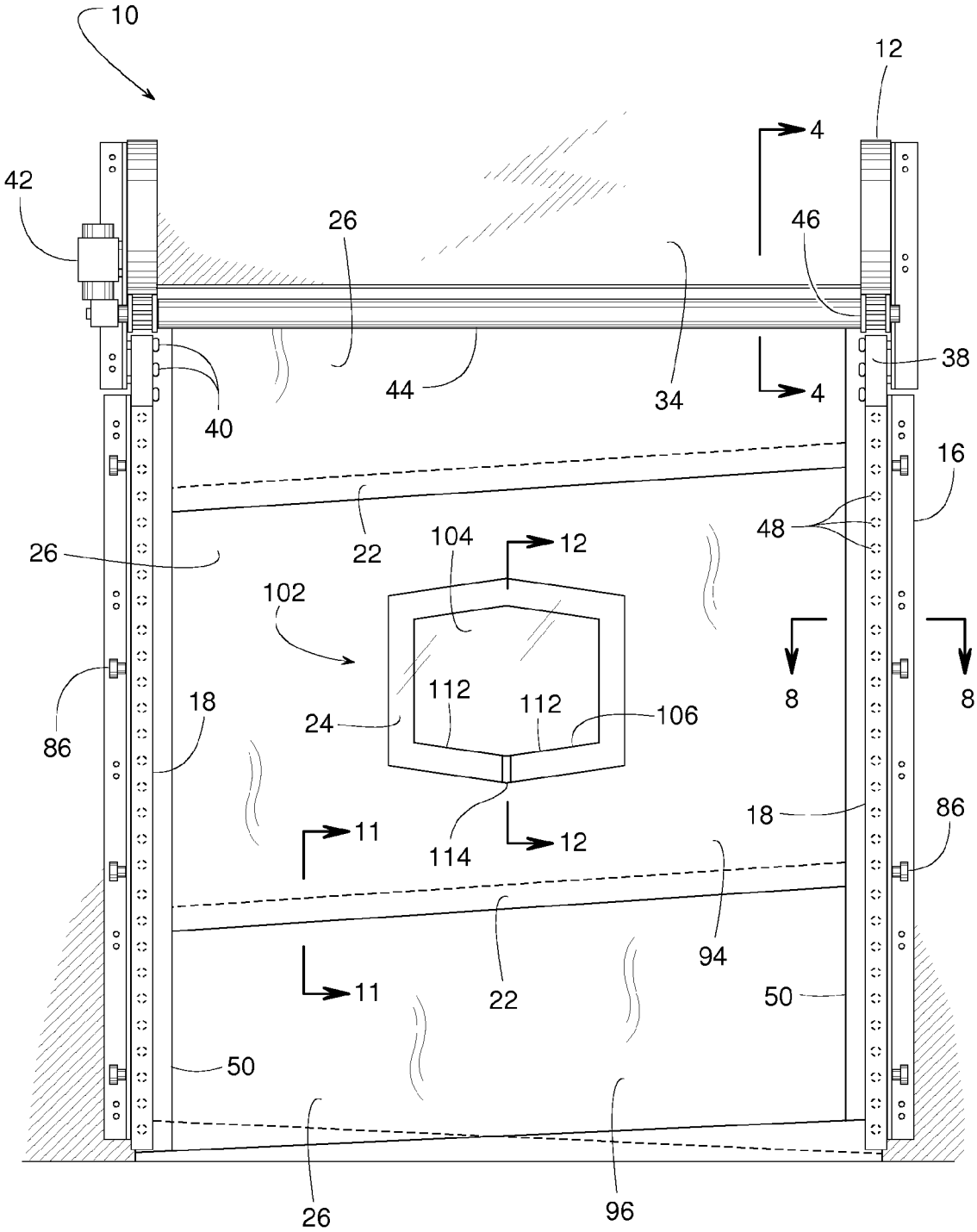
FIG. 1 is a front view of one example of a washdown door shown in a closed position.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any examples may be included with, a replacement for, or otherwise combined with other features from other examples.

Vertically operating doors include numerous intricate parts such as the doors' vertical tracks; seals; overhead storage system; breakaway features; and even the curtain itself, which can be comprised of multiple interconnected sheets and perhaps a window. As a result, these doors can be difficult to keep clean in environments that demand cleanliness. Simpler doors might be easier to washdown; however, such doors lack the benefits of the otherwise preferred doors that have more features.

FIGS. 1-4 show an example a door 10 with various washdown features that make door 10 particularly suited for use in environments that demand cleanliness. Door 10, for example, is useful in the food and drug industry where products and processes are regulated to ensure quality control. To prevent product contamination, such as bacteria and other microorganisms, some example features of door 10 include a solid block curtain storage track 12 with a spiral groove 14, a combination ventilated side frame 16 and a pair of tracks 18 with a removable seal 20, and various curtain seams (e.g., seams 22 and 24) that promote and direct liquid runoff to avoid water-holding pockets and surfaces. It should be noted, however, that door 10 can be used in any application and not just those with high cleanliness requirements.

Figure 2:
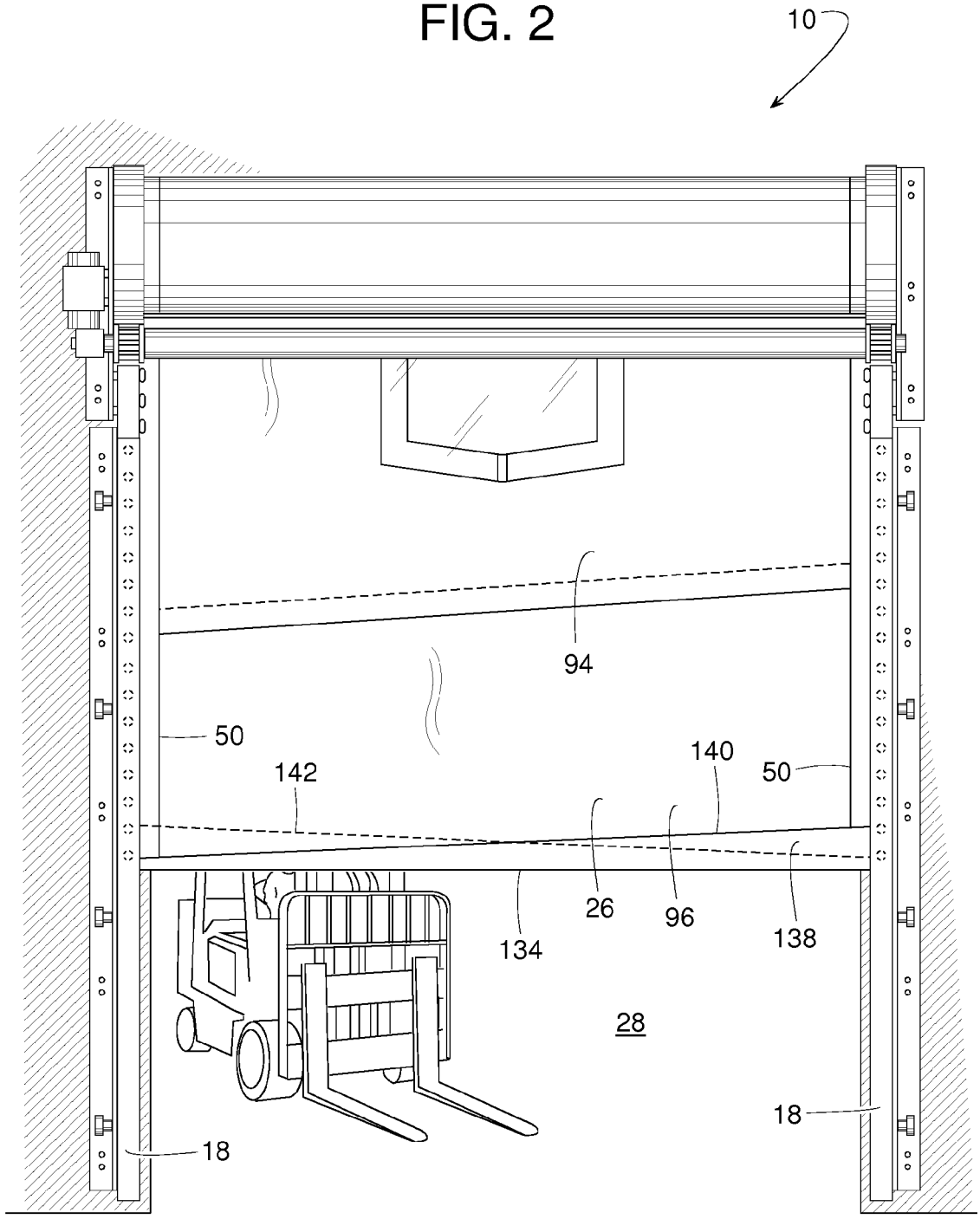
FIG. 2 is a front view of FIG. 1 but showing the door partially open.
Figure 3:
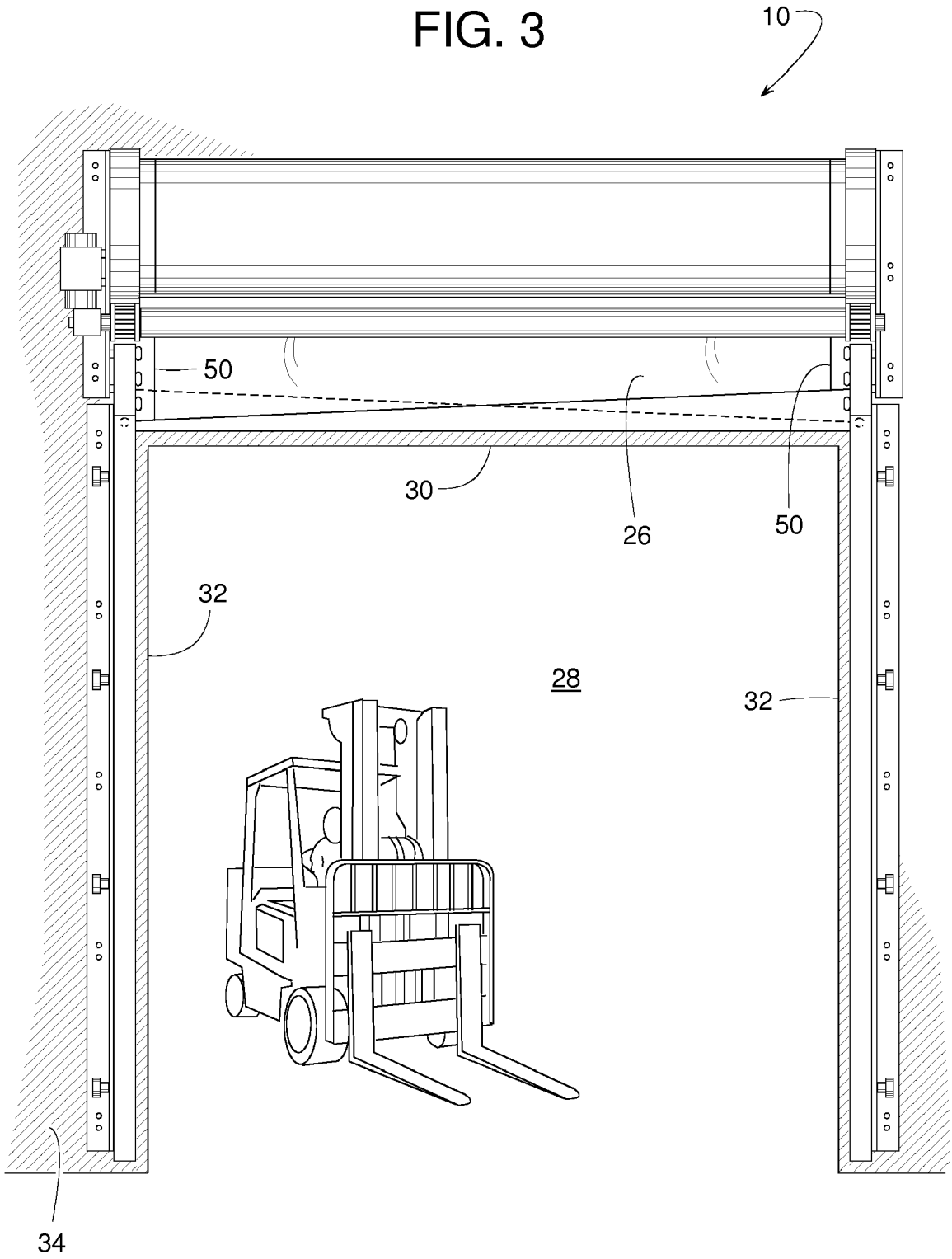
FIG. 3 is a front view of FIG. 1 but showing the door fully open.
Figure 4:
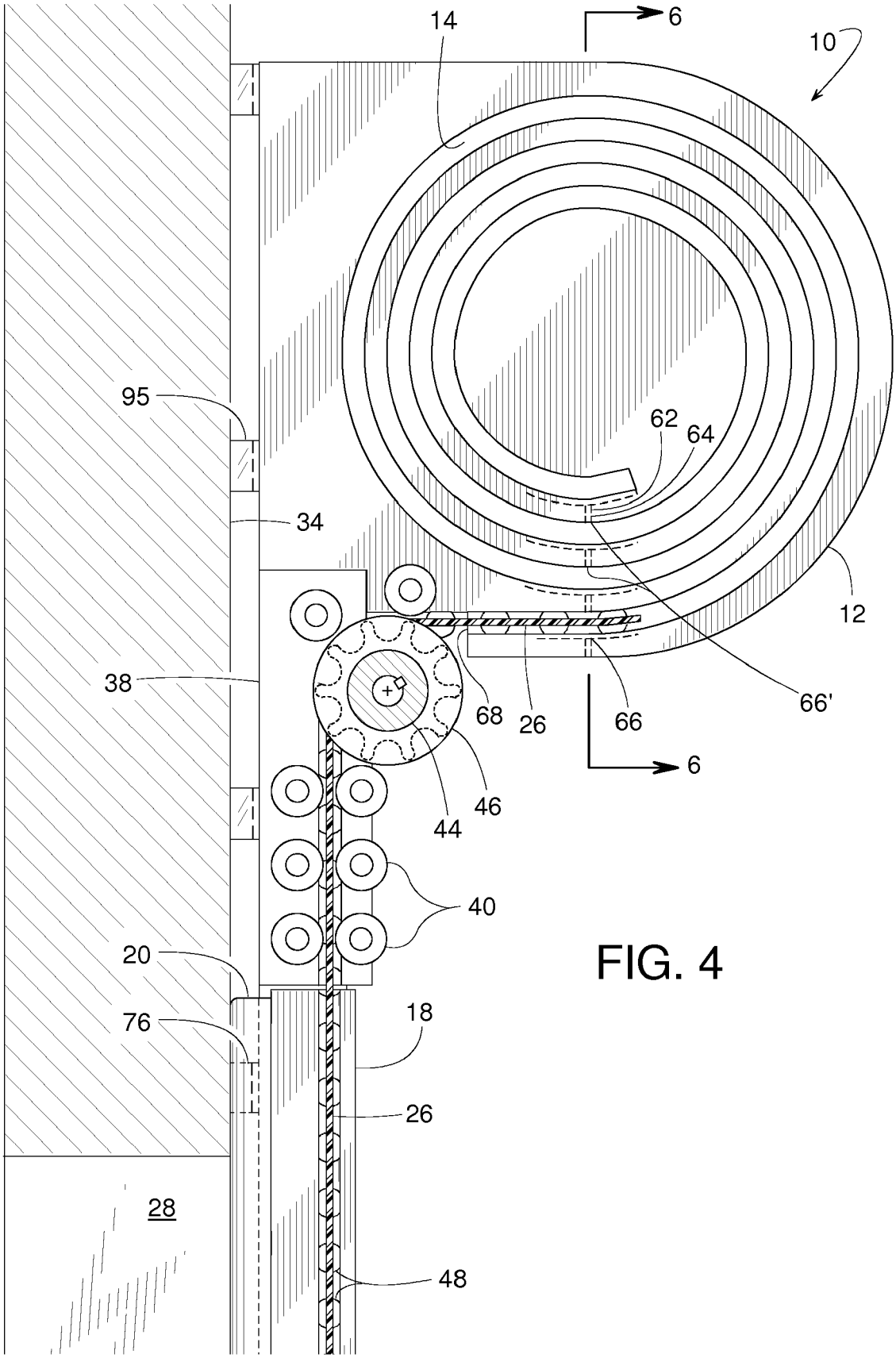
FIG. 4 is a cross-sectional view taken along line 4-4 of FIG. 1.
Figure 5:
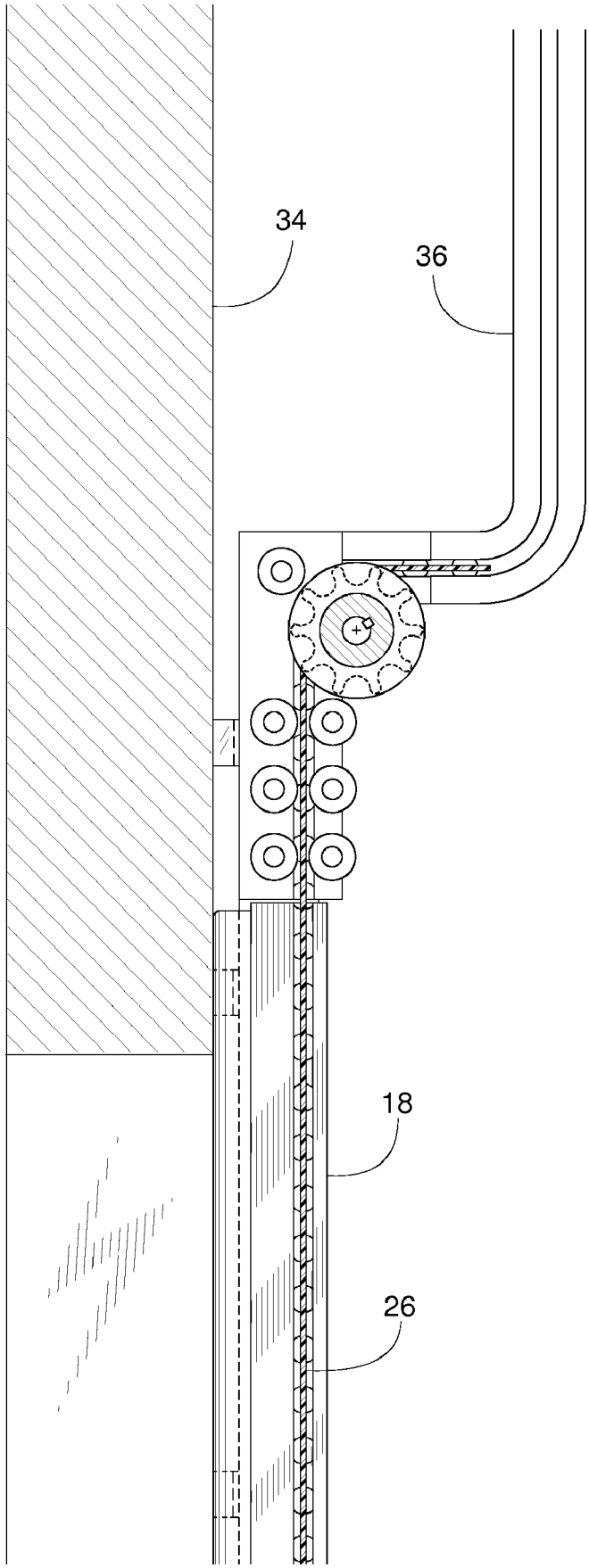
FIG. 5 is a cross-sectional view similar to FIG. 4 but with a different storage track.

Although the actual design details and operation may vary, door 10 is shown comprising a curtain 26 that moves vertically along tracks 18 to open and close the door 10. FIGS. 1 and 4 show door 10 closed, FIG. 2 shows door 10 partially open, and FIG. 3 shows door 10 fully open to expose a doorway 28. Doorway 28 is defined by an upper edge 30 and two lateral edges 32 of a wall 34. In the closed position, curtain 26 is held across doorway 28 between the pair of tracks 18. In the open position, curtain 26 can be stored above doorway 28 and supported by various means including, but not limited to, coiling by virtue of being guided in storage track 12 (FIGS. 4 and 6), wrapped upon an overhead roller, or supported by a generally linear storage track 36 (FIG. 5). For the example of FIGS. 1-4, a transition piece 38 with a series of rollers 40 guides the transfer of curtain 26 between track 18 and storage track 12. In the alternative example of a horizontally moving door (not shown), the curtain could be stored off to the side of the doorway.

In the illustrated example, curtain 26 is powered open and closed by a drive motor 42 that rotates a horizontal shaft 44. At either end of horizontal shaft 44, a cogged drive wheel 46 meshes with a series of protrusions 48 on lateral edges 50 of curtain 26. Depending on the cogged drive wheel's 46 rotational direction, cogged drive wheel 46 pushes curtain 26 up to open door 10 or down to close the door 10. Alternatively, the cogged drive wheel 46 could have protrusions (not shown) that mesh with a series of matching holes (not shown) in the lateral edges 50 of the curtain 26. Many other ways of powering a door open and closed are certainly within the scope of this disclosure.

Figure 6:
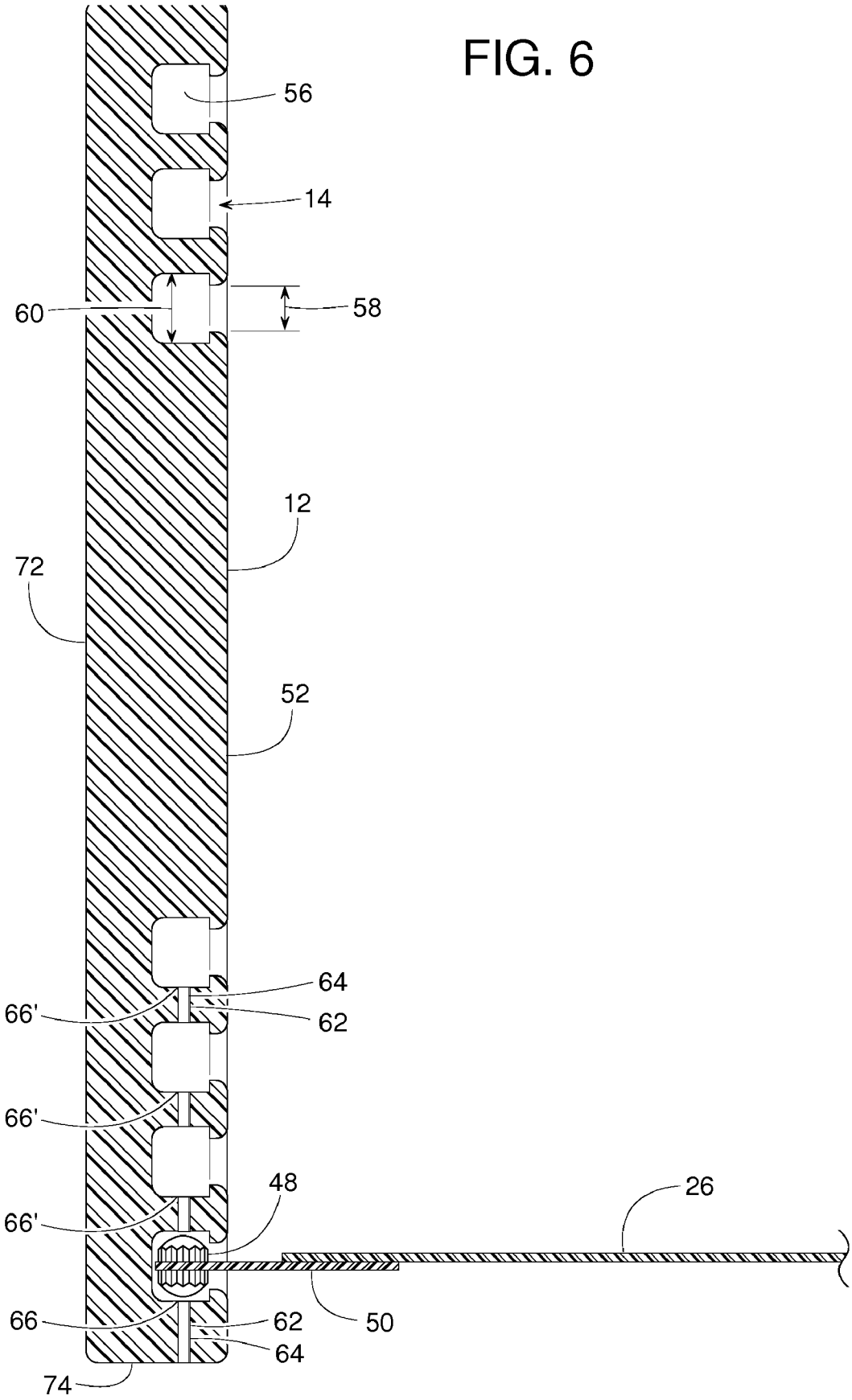
FIG. 6 is a cross-sectional view taken along line 6-6 of FIG. 4.
Figure 7:
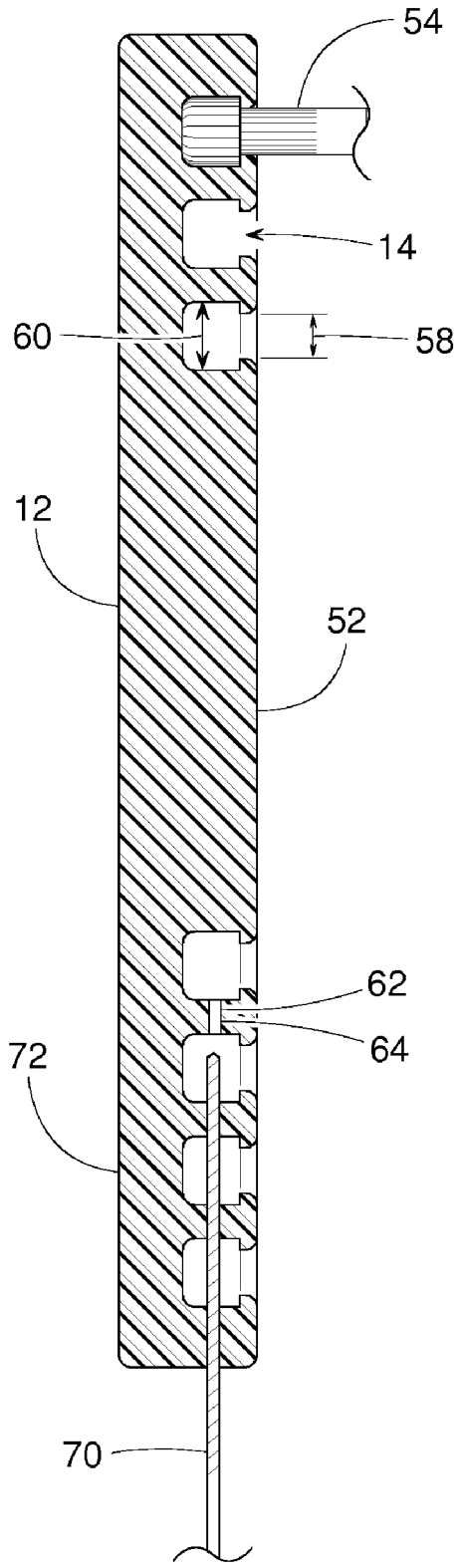
FIG. 7 is a cross-sectional view similar to FIG. 6 but showing the storage track being machined.

Referring to FIGS. 4, 6 and 7 to avoid creating pockets of stagnant water in which bacteria may grow, storage track 12 preferably is machined as a seamless, unitary block of plastic with appropriate drainage at key locations. Storage track 12, for example, includes a face surface 52 into which is milled a continuous spiral groove 14 by way of at least one shaped end mill 54. A resulting cross-sectional area 56 of spiral groove 14 has a relatively narrow curtain-receiving mouth 58 and a deeper wider area 60. As can be seen in FIGS. 6 and 7, the relatively narrow curtain-receiving mouth 58 is adjacent to face surface 52 and leads to the deeper wider area 60. Such cross-sectional area 56 enables storage track 12 to capture and hold the curtain's protrusions 48 within spiral groove 14 while enabling curtain 26 to slide along the spiral groove's 14 relatively narrow curtain-receiving mouth 58.

To avoid retaining stagnant water or other liquids and to enable drainage of any low-lying pockets, the inside lower surfaces of spiral groove 14 preferably are curved or inclined with a drain passageway 62 of some sort leading from those surfaces. Drain passageway 62, for example, can be a drilled hole 64 leading to a lowermost point 66 of wider area 60, and/or drain passageway 62 may include an opening 68 (FIG. 4) where curtain 26 enters spiral groove 14. FIG. 7 shows a drill bit 70 creating drain passageway 62 by drilling the substantially cylindrical, linear hole 64 that leads to a plurality of discrete points 66' or low-lying pockets in spiral groove 14. As an alternative to a single drilled hole, multiple holes could be drilled from a backside 72 of storage track 12, wherein each hole leads to a discrete point 66'. Another alternative would be to mill a slot in backside 72, wherein the slot would extend into spiral groove 14, break out through a bottom edge 74 of storage track 12, and connect points 66 and 66' in fluid communication with each other.

Figure 8:
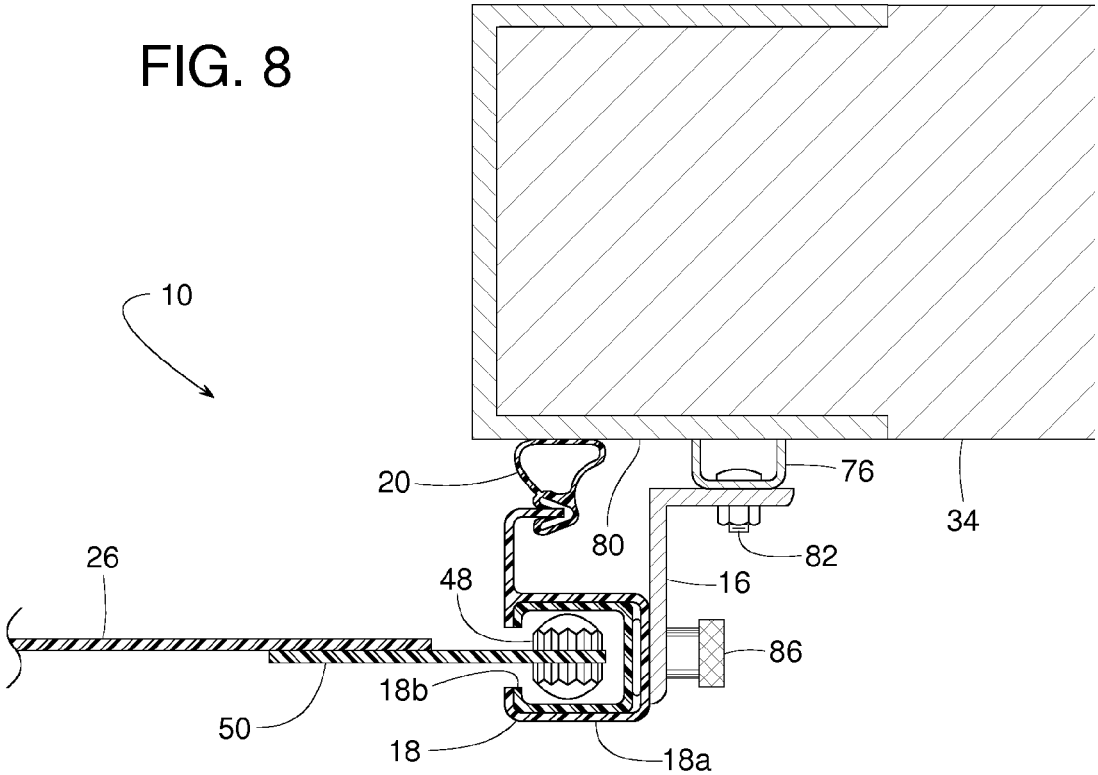
FIG. 8 is a cross-sectional view taken along line 8-8 of FIG. 1.
Figure 9:
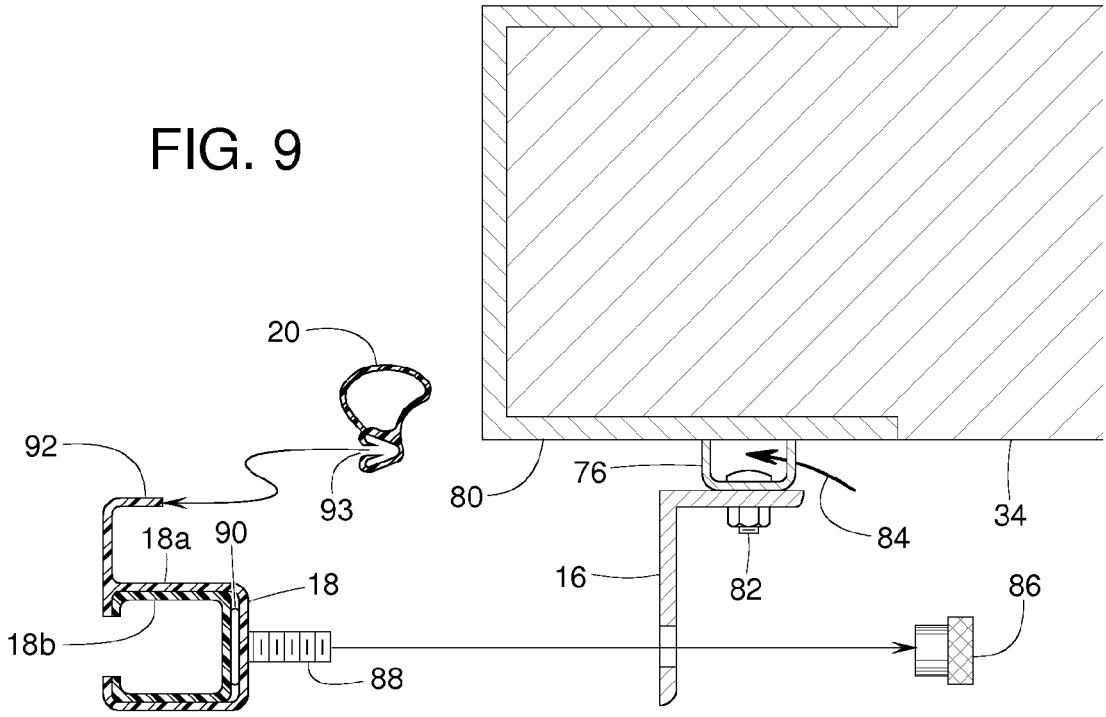
FIG. 9 is a cross-sectional view similar to FIG. 8 but some parts removed.
Figure 10:
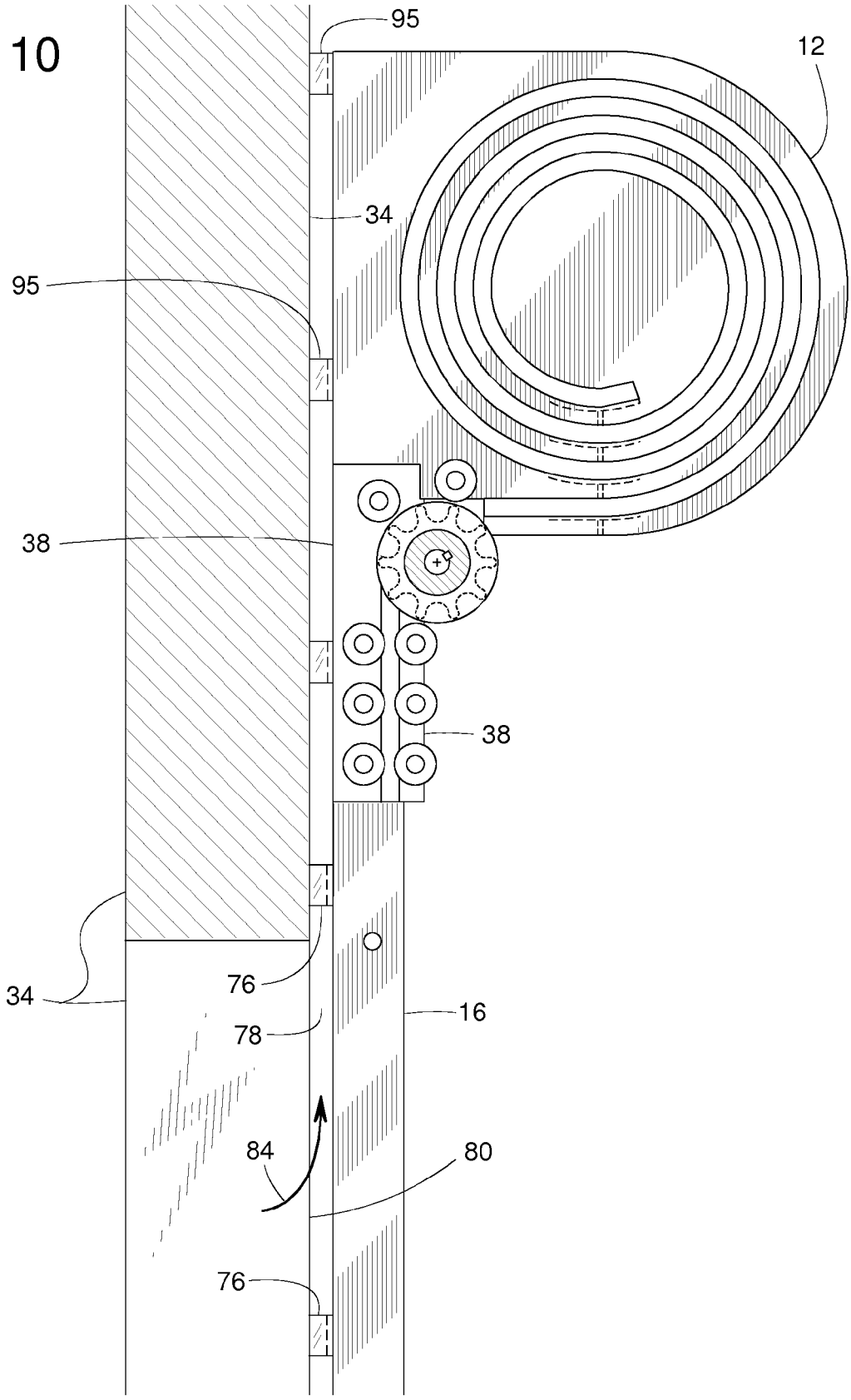
FIG. 10 is a cross-sectional view similar to FIG. 4 without the removed parts of FIG. 9.

Referring to FIGS. 8-10, to help prevent water and other liquids from collecting on track 18 and to make the track 18 area easier to washdown and sanitize, door 10 includes removable seal 20 and/or removable track 18, and also includes a plurality of standoffs 76 that create ventilating air gaps 78 between side frame 16 (e.g., track-supporting side frame) and a mounting surface 80 of wall 34. In this example, each standoff 76 may be a U-shaped, stainless steel channel that can be attached to a backside of side frame 16 by way of a screw 82, welding, or other means. Side frame 16 and standoffs 76 can then be attached to wall 34 by way of a conventional anchor bolt, welding (if mounting surface 80 can be welded), or by other attachment means. Side frame 16 preferably is made of a stainless steel to resist corrosion and to provide sturdy support for door 10 overall.

To seal off air currents 84 that might otherwise leak past through ventilating air gaps 78, removable seal 20 extends between track 18 and wall 34, as shown in the example, and/or removable seal 20 extends between side frame 16 and wall 34. In either case, removable seal 20 is removably coupled to side frame 16. The term, "removably" means the part is intentionally constructed such that it can be detached and later reattached without appreciable damage, wherein detaching is by way of disassembly as opposed to cutting, breaking or melting apart. Although track 18 and side frame 16 are shown as two separable pieces, which provides an important benefit, track 18 and side frame 16 could be a unitary piece, whereby side frame 16 would integrally include track 18. Whether side frame 16 and track 18 are separable or a single piece, track 18 is still referred to as being "disposed on" side frame 16.

By having track 18 and side frame 16 being separate pieces, as shown, side frame 16 can be heavy and strong for supporting door 10, while track 18 can be of a plastic material that is lightweight and readily removable. Removing track 18 and removable seal 20 opens up ventilating air gaps 78 between wall 34 and side frame 16 so that those now-open areas can be washed periodically, and the removed parts can be washed separately. To facilitate frequent washings, track 18 preferably is "hand-removable," which means that track 18 can be removed manually without using tools. To render track 18 hand-removable, track 18 is fastened to side frame 16 by way of a knurled nut 86 or wing nut that screws onto a screw 88 having a head 90 held within track 18.

Although track 18 and removable seal 20 can be removed as a unit, the two pieces 18 and 20 preferably are a three-part assembly comprising a track case 18*a*, a track liner 18*b*, and removable seal 20. By having three individual parts 18*a*, 18*b* and 20, each piece 18*a*, 18*b* and 20 can be made of a material that is particularly suited for its intended purpose. Track case 18*a*, for instance, can be made of polycarbonate because this plastic exhibits high impactability, broad temperature stability, is inherently non-corrosive, and can be flexed repeatedly and resiliently. The resilient flexibility enables the curtain's 26 lateral edges 50 and protrusions 48 to be forcibly yet restorably pulled out from within track 18 in the event of a forklift-curtain impact, thereby avoiding damage to door 10. Track liner 18*b* can be made of UHMW (ultra high molecular weight polyethylene) for its excellent wear resistance. Removable seal 20 can be made of a neoprene, latex, silicone or similar rubbery material that can readily conform to the surface of wall 34. All three parts 18*a*, 18*b* and 20 preferably are made of polymeric materials so that the three-part assembly together is sufficiently lightweight (e.g., less than 50 lbs.) for hand-removal. For the illustrated example, track 18 includes a flange 92 that press-fits into a slot 93 in removable seal 20, thus removable seal 20 is hand-removable from track 18.

In FIG. 10, it should be noted that U-shaped channel standoffs 95, similar to standoffs 76, are interposed between wall 34 and the backside of storage track 12 and transition piece 38, thereby providing spaced-apart ventilation in those areas as well.

Figure 11:
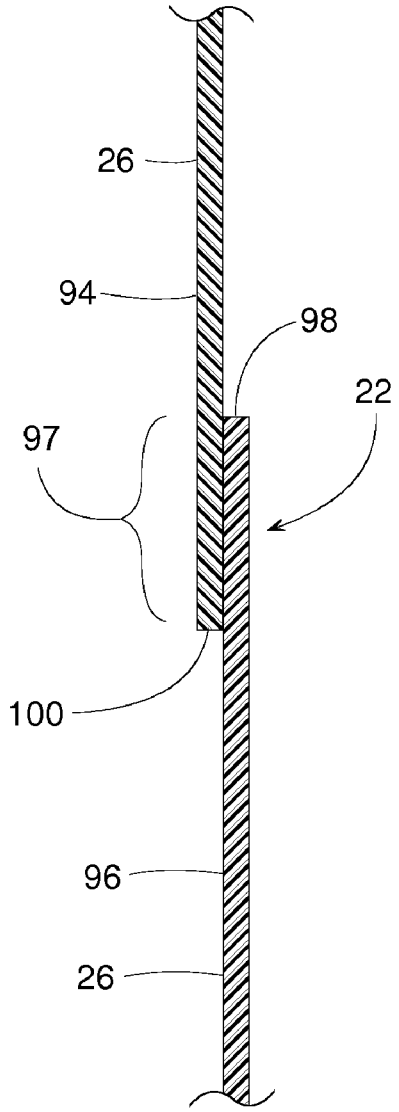
FIG. 11 is a cross-sectional view taken along line 11-11 of FIG. 1.
Figure 12:
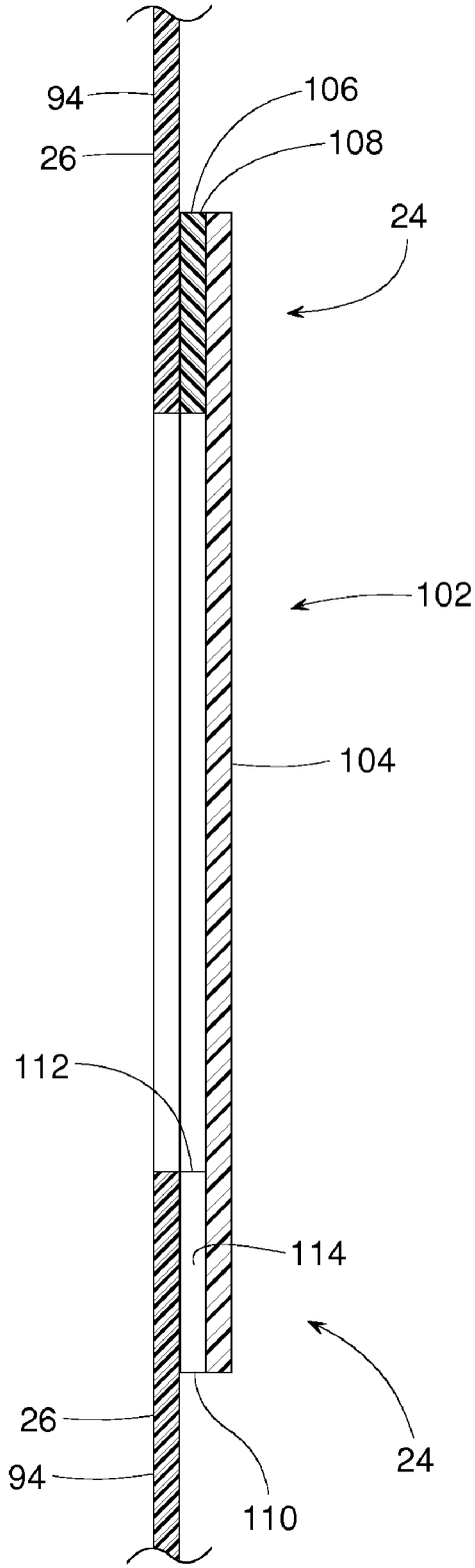
FIG. 12 is a cross-sectional view taken along line 12-12 of FIG. 1.

Returning to FIG. 1 with further reference to FIGS. 11 and 12, curtain 26 includes inclined, moisture-guiding seam 22 that promotes and directs liquid runoff toward one or more of the curtain's 26 lateral edges 50. The term, "seam" means a joint. Further, the "seam" or joint may result from two ends of fabric butting up against each other, but may also include overlapping joints. Such overlapping joints may be preferable here, as they yield "free" fabric edges that serve as collection and runoff paths for liquids, especially when inclined as described below. The joint, for example, can be glued, sewn, taped, thermally welded, ultrasonically welded, intermolecularly bonded, etc. The term, "incline" means that the seam is sloped and is thus neither perfectly vertical nor perfectly horizontal. The seam 22 being at an appreciable incline avoids creating water-holding surfaces on curtain 26 itself and directs drips off to the side of doorway 28, thereby minimizing the possibility of liquid dripping onto products passing directly underneath curtain 26. Seams 22 and 24 preferably are at a slope of at least 0.033 and preferably at least 0.050 with the slope values being in terms of vertical rise over horizontal run. Seams at shallower inclines are certainly possible and well within the scope of this disclosure.

For sake of example, FIG. 11 shows seam 22 being a lap joint 97 between an upper pliable sheet 94 of curtain 26 and a lower pliable sheet 96 of curtain 26. On one side of curtain 26, lap joint 97 provides an upward-facing ledge 98 along which liquid may flow away from the center of doorway 28. On the opposite side of curtain 26, lap joint 97 provides a downward-facing ledge 100. By dispersive adhesion, water can cling to downward-facing ledge 100 and run along that downward-facing ledge 100 toward the curtain's 26 lateral edge 50.

FIG. 12 shows seam 24 disposed along an outer periphery of a window 102. Curtain 26 and a transparent sheet 104 of window 102 can each be considered as either an upper pliable sheet or a lower pliable sheet, depending on their relative positions. In this example, seam 24 is created by an intermediate sheet 106 coupling transparent sheet 104 to curtain 26. An upward-facing ledge 108 of seam 24 is sloped to convey water off to either lateral edge of window 102. A downward-facing ledge 110 of seam 24, lying along an incline, relies on dispersive adhesion to also direct water off to the side. A pair of upward-facing ledges 112 of seam 24 slope downward toward the center of window 102 to direct water down through a gap 114 between the two upward-facing ledges 112 and between curtain 26 and transparent sheet 104. Liquid draining down through gap 114 and down around window 102 can be captured by the lower seam 22, which then directs the liquid off to the curtain's 26 lateral edge 50.

Figure 13:
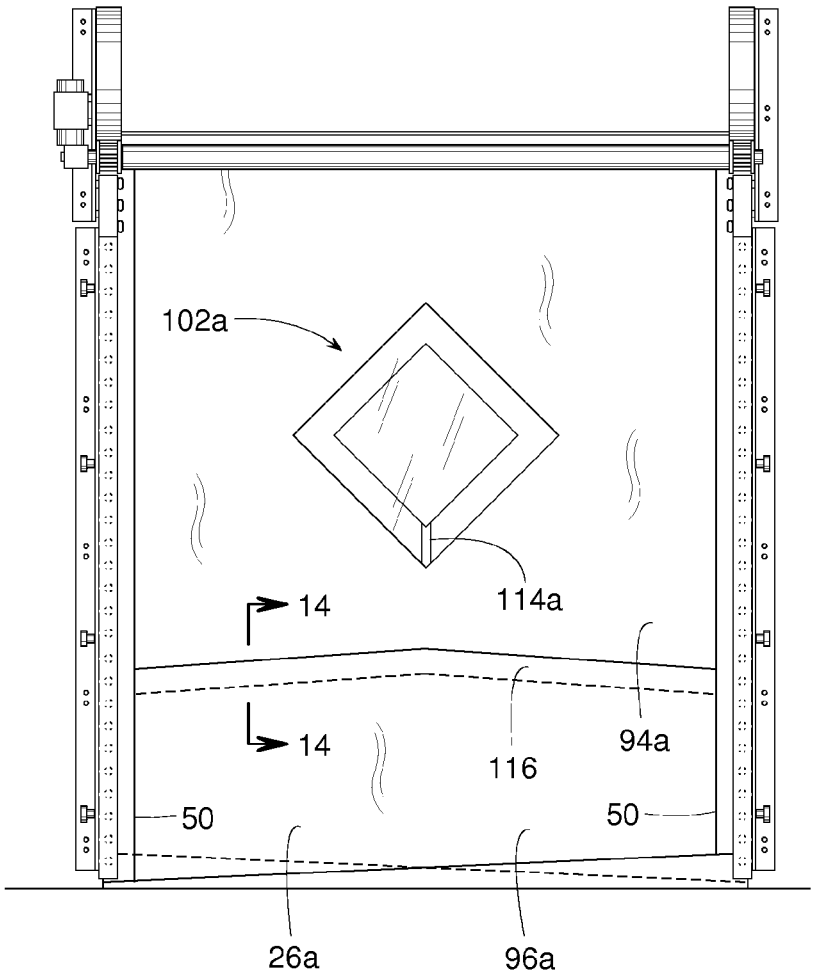
FIG. 13 is a front view similar to FIG. 1 but showing a different door example.
Figure 14:
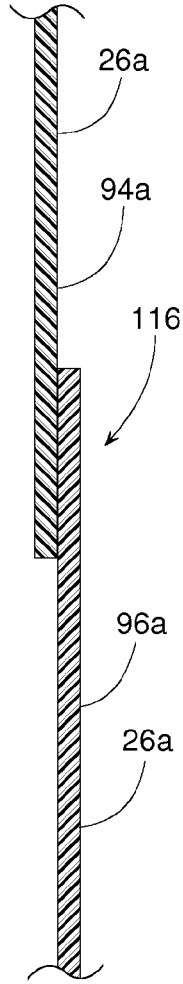
FIG. 14 is a cross-sectional view taken along line 14-14 of FIG. 13.

FIGS. 13 and 14 show a moisture-guiding seam 116 similar to seam 22. In this example, moisture-guiding seam 116 is at a joint between slightly modified upper and lower pliable sheets 94*a* and 96*a*. Moisture-guiding seam 116 peaks near the center of doorway 28 and slopes downward in either direction to direct water toward both lateral edges 50 of a curtain 26*a*. A window 102*a* is in a diamond shape to create inclined water-conveying ledges but is otherwise similar in construction to that of window 102. Window 102*a* has a gap 114*a* similar to gap 114 of window 102.

Figure 15:
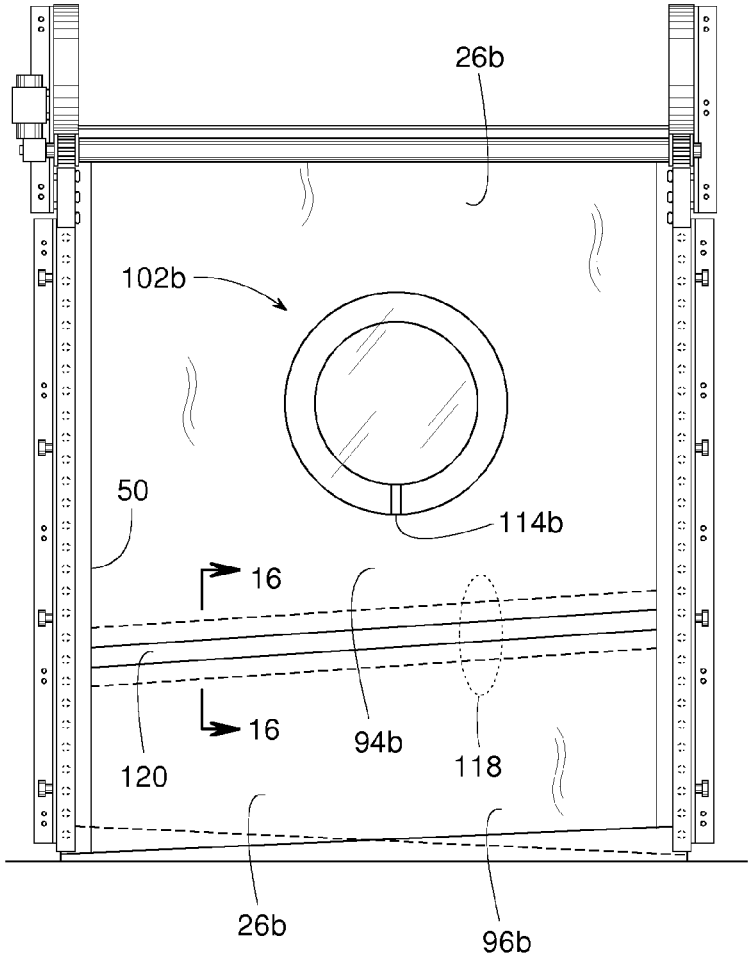
FIG. 15 is a front view similar to FIGS. 1 and 13 but showing another door example.
Figure 16:
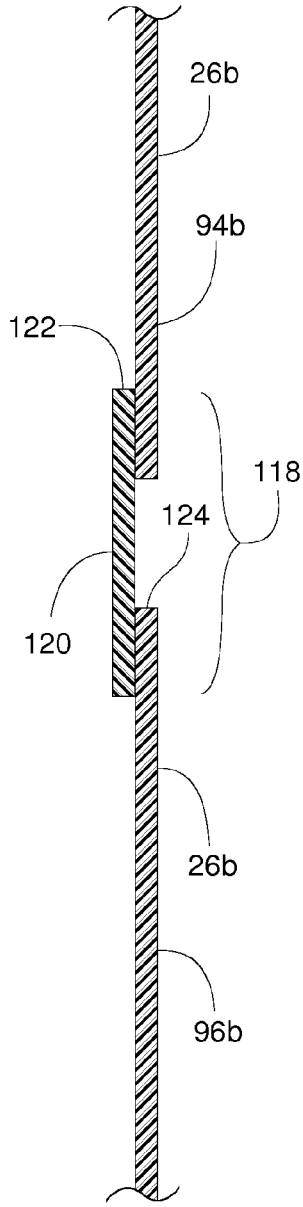
FIG. 16 is a cross-sectional view taken along line 16-16 of FIG. 15.

FIGS. 15 and 16 show an inclined moisture-guiding seam 118 provided by an intermediate sheet 120 joining an upper pliable sheet 94*b* of a curtain 26*b* to a lower pliable sheet 96*b* of curtain 26*b*. In this example, inclined moisture-guiding seam 118 includes two upward-facing ledges 122 and 124 that can direct water off to the curtain's 26*b* lateral edge 50. A window 102*b* is generally round to create downward-curving, water-conveying ledges but is otherwise similar in construction to that of windows 102 and 102*a*. Window 102*b* has a gap 114*b* similar to gap 114 of window 102.

Figure 17:
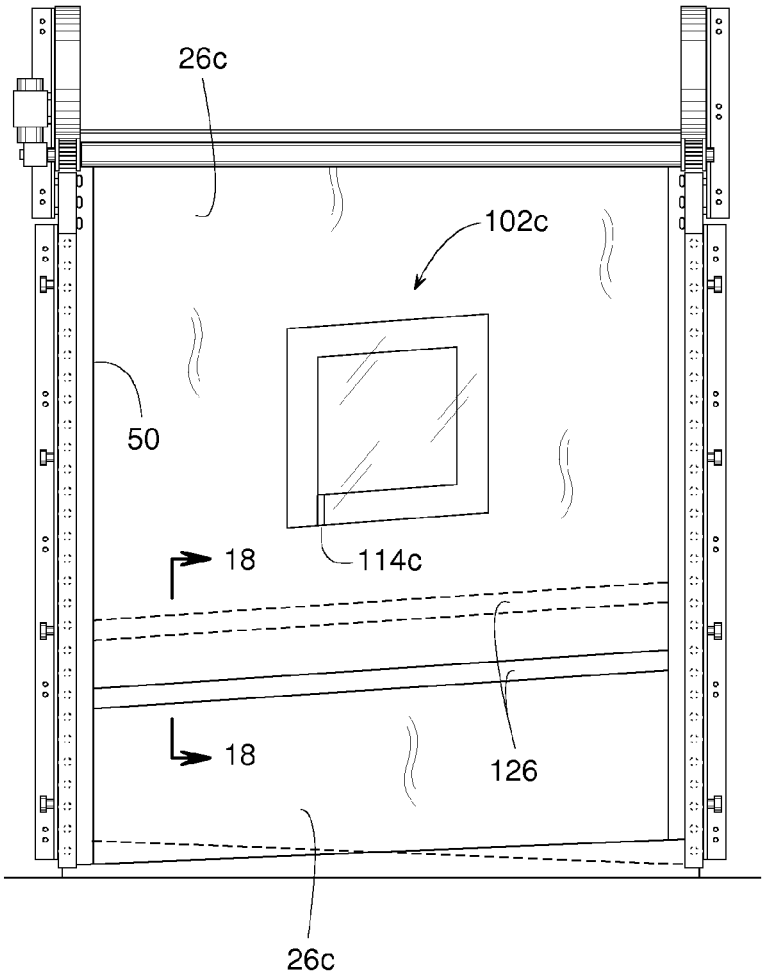
FIG. 17 is a front view similar to FIGS. 1, 13 and 15 but showing yet another door example.
Figure 18:
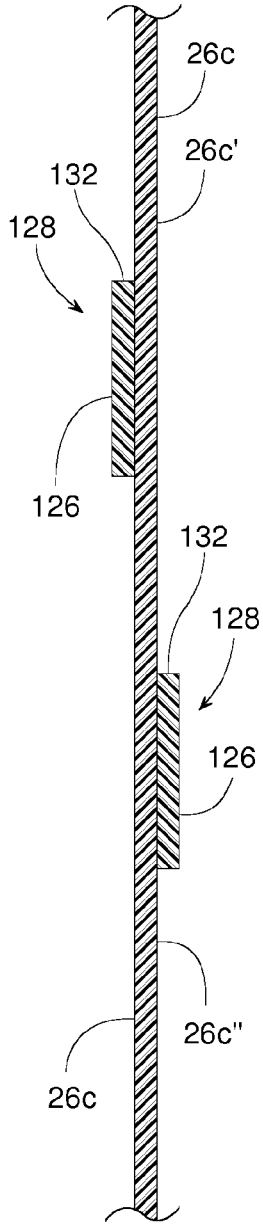
FIG. 18 is a cross-sectional view taken along line 18-18 of FIG. 17.

FIGS. 17 and 18 show a curtain 26*c* with two add-on sheets 126 that provide moisture-guiding seams 128. Each moisture-guiding seam 128 has an upward-facing ledge 132 that lies at an incline to direct water off to the curtain's 26*c* lateral edge 50. In this example, curtain 26*c* is a continuous, unitary sheet. Although curtain 26*c* comprises an upper pliable sheet 26*c*' and a lower pliable sheet 26*c*", sheets 26*c*' and 26*c*" are an integral extension of each other, so moisture-guiding seam 128 does not join sheets 26*c*' and 26*c*", but rather each moisture-guiding seam 128 is created by add-on sheet 126 being joined to the face of curtain 26*c*.

FIG. 17 also shows a window 102*c* in the shape of a parallelogram to create inclined upper and lower water-conveying ledges but is otherwise similar in construction to that of window 102. Window 102*c* has a gap 114*c* similar to gap 114 of window 102.

Figure 19:
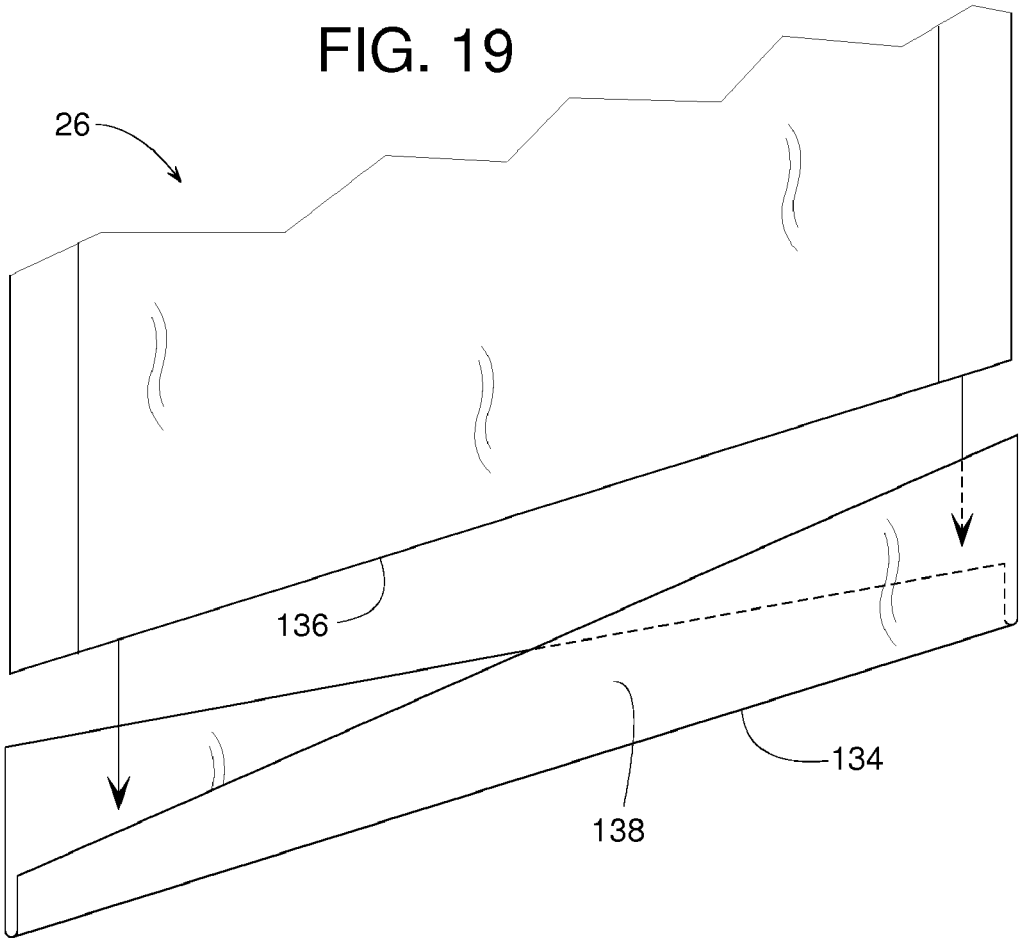
FIG. 19 is an exploded perspective view showing one example of a curtain's lower edge assembly.
Figure 20:
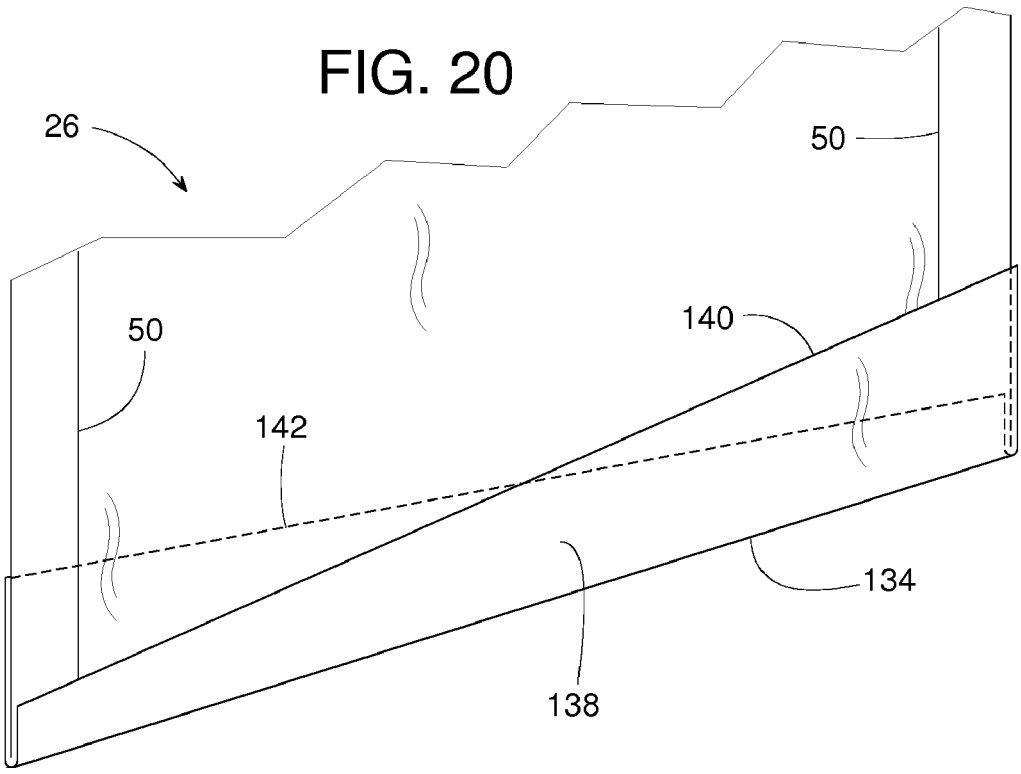
FIG. 20 is a perspective view showing the example curtain's lower edge assembled.

To avoid or minimize water dripping near the center of the doorway (e.g., doorway 28) from a lower edge 134 of curtain 26 and to seal off perhaps a rough cut edge 136 at the bottom of curtain 26, lower edge 134 can be finished as shown in FIGS. 19 and 20. In this example, a finishing sheet 138 begins as a generally rectangular sheet that is folded at a diagonal to create two moisture-guiding seams 140 and 142 with upward-facing ledges 132 that, on opposite faces of curtain 26, slope downward in opposite directions toward either lateral edge 50 of curtain 26. The slope angle of moisture-guiding seams 140 and 142 preferably are similar to the other example moister-guiding seams disclosed herein. Finishing sheet 138 can be attached to curtain 26 by various means including, but not limited to, adhesively taping, gluing, welding, sewing, etc. In some examples, joining finishing sheet 138 to curtain 26 preferably is done with adhesive tape, which provides additional thickness for the upward-facing ledges 132 of moisture-guiding seams 140 and 142. Finishing sheet 138 preferably overlies lateral edges 50; however, lateral edges 50 overlying finishing sheet 138 is also well within the scope of this disclosure.

In some examples of the moisture-guiding seams 140 and 142 and ledges 100 and/or 132 (e.g., water-conveying ledges), it may be beneficial to have certain surfaces more water repellant than adjacent surfaces. The expression, "more water repellant," as used herein means a surface having less strength of adhesion to water, thus water will tend to cling to surfaces that are less water repellant than to surfaces that are more water repellant. In the example of FIG. 18, making add-on sheet 126 more water repellant than the adjacent surface of curtain 26*c* will urge water to cling more to curtain 26*c* instead of running straight down off of upper-facing ledge 132. In the example of FIG. 11, water may have a greater tendency to cling to the downward-facing ledge 100 if the adjoining surface of lower pliable sheet 96 is more water repellant than the downward-facing surface of downward-facing ledge 100. The water repellency of a sheet can be set or established by the sheet's material composition, surface coating, and/or the sheet's surface roughness.

At least some of the aforementioned examples include one or more features and/or benefits including, but not limited to, the following:

In some examples, a door with a pliable curtain includes an inclined seam that not only joins two component sheets of the curtain together but also provides a moisture-guiding ledge that directs curtain drainage toward a lateral edge of the curtain.

In some examples, a downward-facing ledge directs water along a downward slope off to a lateral edge of a door curtain.

In some examples, a door includes a curtain with a window, wherein water drains through a gap between a face of the curtain and a transparent sheet of the window.

In some examples, a door curtain has an inclined lowermost edge that is sufficiently pliable to lie flat against the floor when the door is closed.

In some examples, a door with a pliable curtain includes a seamless storage track machined from a single block of plastic, wherein the storage track includes a spiral groove with liquid drainage at all the low areas of the groove.

In some examples, a door includes a curtain guided by a vertical track, wherein the track is disposed on a side frame. A series of standoffs provides a washdown air gap between the side frame and the wall to which the frame is mounted. When not being washed down, a removable seal is installed to block off the air gap.

In some examples, a door includes a curtain guide assembly comprised of four main parts: a side frame, track case, track liner, and a seal, wherein each of the four parts are made of a different material.

In some examples, the curtain guide assembly is readily disassembled and reassembled without the need for tools.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A door for a doorway in a wall, the door comprising:

a side frame that is elongate and mountable to the wall;

a track to be disposed on the side frame, wherein the track is elongate and is to be generally parallel to the side frame;

a curtain to be moved along the track to selectively open and close the door;

a plurality of standoffs to be interposed between the side frame and the wall such that when the side frame is mounted to the wall, the standoffs provide an appreciable air gap to convey a current of air between the side frame and the wall; and a seal to be removably coupled to the side frame and spaced-apart from the standoffs, the seal is elongate and generally parallel to the side frame and extends to the wall to obstruct a current of air when the seal is coupled to the side frame while the side frame is attached to the wall.

2. The door of claim 1, wherein the track is to be removably attached to the side frame.

3. The door of claim 2, wherein the track is to be hand-removable from the side frame, whereby removal of the track from the side frame can be accomplished without tools.

4. The door of claim 1, wherein the side frame is heavier than the track.

5. The door of claim 1, wherein the side frame is comprised of metal and the track is comprised of plastic.

6. The door of claim 1, wherein the seal is to be attached to the track.

7. The door of claim 6, wherein the seal is to be removably attached to the track.

8. The door of claim 7, wherein the seal is to be hand-removable from the track, whereby removal of the seal from the track can be accomplished without tools.

9. The door of claim 1, wherein the plurality of standoffs are each comprised of a U-shaped channel.

10. The door of claim 1, further comprising a moisture-guiding seam between an upper pliable sheet and a lower pliable sheet of the curtain, the moisture-guiding seam is to extend continuously along an appreciable incline between the track and a second track to enable moisture to be guided toward one or more lateral edges of the curtain.

11. The door of claim 10, wherein the seam does not join the upper pliable sheet to the lower pliable sheet.

12. The door of claim 10, wherein the moisture-guiding seam joins the upper pliable sheet to the lower pliable sheet.

13. The door of claim 11, further comprising a lap joint at the moisture-guiding seam, wherein the lap joint creates an upward-facing ledge on one side of the curtain and creates a downward-facing ledge on an opposite side of the curtain.

14. The door of claim 10, further comprising an intermediate sheet coupling the upper pliable sheet to the lower pliable sheet, wherein the moisture-guiding seam connects the intermediate sheet to the upper pliable sheet.

15. The door of claim 10, wherein the upper pliable sheet and the lower pliable sheet are an integral extension of each other so that the upper pliable sheet and the lower pliable sheet comprise a unitary piece.

16. The door of claim 15, further comprising an intermediate sheet, wherein the moisture-guiding seam connects the intermediate sheet to the upper pliable sheet.

17. The door of claim 10, further comprising an intermediate sheet at the moisture-guiding seam, wherein the intermediate sheet is more water repellant than the upper pliable sheet.

18. The door of claim 10, wherein the moisture-guiding seam slopes downward from a first point to a second point, wherein the first point is to be adjacent the track, and the second point is to be adjacent the second track.

19. The door of claim 10, wherein the moisture-guiding seam is to be lowest at each track.

20. The door of claim 10, further comprising a window, and the moisture-guiding seam is at the window.

21. The door of claim 1, further comprising a unitary block of plastic that includes a face surface, the unitary block of plastic defines a spiral groove along which the curtain is to travel as the door opens and closes, a cross-sectional area of the spiral groove has a relatively narrow curtain-receiving mouth and a deeper wider area, the relatively narrow curtain-receiving mouth is adjacent the face surface and leads to the deeper wider area, the unitary block of plastic defines a drain passageway at a lowermost point of the deeper wider area.

22. The door of claim 21, wherein the drain passageway is open to a plurality of discrete points in the spiral groove.

23. The door of claim 22, wherein the drain passageway is substantially linear and substantially cylindrical.

24. The door of claim 21, wherein the drain passageway comprises a linear hole connecting portions of the spiral groove.

25. The door of claim 21, wherein the drain passageway comprises a lateral aperture.

26. The door of claim 21, wherein the drain passageway comprises a slot defined by the unitary block connecting portions of the spiral groove.

* * * * *